US008677790B2

(12) United States Patent
Ramsey

(10) Patent No.: US 8,677,790 B2
(45) Date of Patent: Mar. 25, 2014

(54) SECURITY ENCLOSURE AND ASSOCIATED METHOD

(76) Inventor: Rex A. Ramsey, Forney, TX (US)

( * ) Notice: Subject to any disclaimer, the term of this patent is extended or adjusted under 35 U.S.C. 154(b) by 0 days.

(21) Appl. No.: 13/328,660

(22) Filed: Dec. 16, 2011

(65) Prior Publication Data

US 2013/0154450 A1 Jun. 20, 2013

(51) Int. Cl.
*F25D 23/02* (2006.01)
*E05B 73/00* (2006.01)

(52) U.S. Cl.
USPC ..... 70/163; 70/58; 109/49.5; 109/52; 52/79.5

(58) Field of Classification Search
USPC ..... 70/14, 18, 58, 62, 63, 158, 163, 164; 109/49.5, 50–52; 52/79.5, 79.9, 79.13, 52/106, 655.1
See application file for complete search history.

(56) References Cited

U.S. PATENT DOCUMENTS 4,509,805 A * 4/1985 Welsch et al. ..... 312/210
5,108,166 A * 4/1992 Klix ..... 312/329
6,138,993 A * 10/2000 Mitchell et al. ..... 256/25
6,158,175 A * 12/2000 Carter ..... 52/79.5
6,401,427 B1 * 6/2002 Snyder ..... 109/49.5
6,430,954 B1 * 8/2002 Smith ..... 62/259.1
6,786,009 B1 * 9/2004 McGunn et al. ..... 52/36.2
6,851,771 B2 * 2/2005 Marler et al. ..... 312/249.8
6,962,067 B1 * 11/2005 Chapman ..... 70/18
7,314,258 B2 * 1/2008 Sakanoue ..... 70/14
7,360,380 B2 * 4/2008 Van Handel ..... 70/63
7,836,653 B1 * 11/2010 Herrington ..... 52/473
7,934,444 B2 * 5/2011 Carberry et al. ..... 109/49.5
8,137,769 B1 * 3/2012 Copeland ..... 428/18
8,156,690 B2 * 4/2012 Higley ..... 52/79.5
2004/0074158 A1 * 4/2004 De Zen ..... 52/79.9
2006/0180059 A1 8/2006 Martin
2007/0175108 A1 * 8/2007 Stein et al. ..... 52/79.5
2009/0056237 A1 * 3/2009 Dickinson et al. ..... 52/79.5
2009/0249842 A1 * 10/2009 Coon ..... 70/58
2010/0081371 A1 * 4/2010 Dinicolas ..... 454/275
2010/0259139 A1 * 10/2010 Tussy ..... 312/213

* cited by examiner

*Primary Examiner* — Christopher Boswell
(74) *Attorney, Agent, or Firm* — Smith IP Services, P.C.

(57) ABSTRACT

A security enclosure that may include at least three supports with each support secured to a surface, at least two panels with each panel installed between adjacent ones of the supports, and a locking device that may selectively permit and prevent removal of the panels. A method of securing equipment in a security enclosure that may include the steps of arranging supports around the equipment being secured, and securing the supports. The method may also include inserting a panel in the supports and inserting another panel in the supports. One panel may prevent removal of the other panel from the supports, and each of the panels may be retained between the adjacent ones of the supports.

27 Claims, 8 Drawing Sheets

SECURITY ENCLOSURE AND ASSOCIATED METHOD

BACKGROUND

This disclosure relates generally to security systems and, in an example described below, more particularly provides a security enclosure.

Theft of indoor and/or outdoor equipment can be very expensive for homeowners and/or businesses. Lost equipment may result in significant inconveniences for homeowners or lost production for businesses. For example, if an outside air-conditioning unit is stolen, the homeowners may not be able to occupy the home until repairs are made and/or the unit replaced. Similarly, businesses may require workers to leave the workplace until repairs are made. Therefore, it can be seen that improvements in the art are needed.

SUMMARY

In the disclosure below, a security enclosure and associated method are provided which brings improvements to the art of security systems. One example is described below in which the security enclosure may include supports secured to a surface, panels installed between adjacent ones of the supports, and a locking device to secure the panels in place.

In one aspect, a security enclosure is provided which may include multiple supports with each support secured to a surface, multiple panels with each panel installed between adjacent supports, and a locking device which may selectively permit or prevent removal of the panels.

In another aspect, a method of securing equipment in a security enclosure is provided which may include the steps of arranging supports around the equipment being secured, securing the supports, and inserting two panels in the supports, where one panel may prevent removal of the other panel and each panel may be retained between adjacent ones of the supports.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
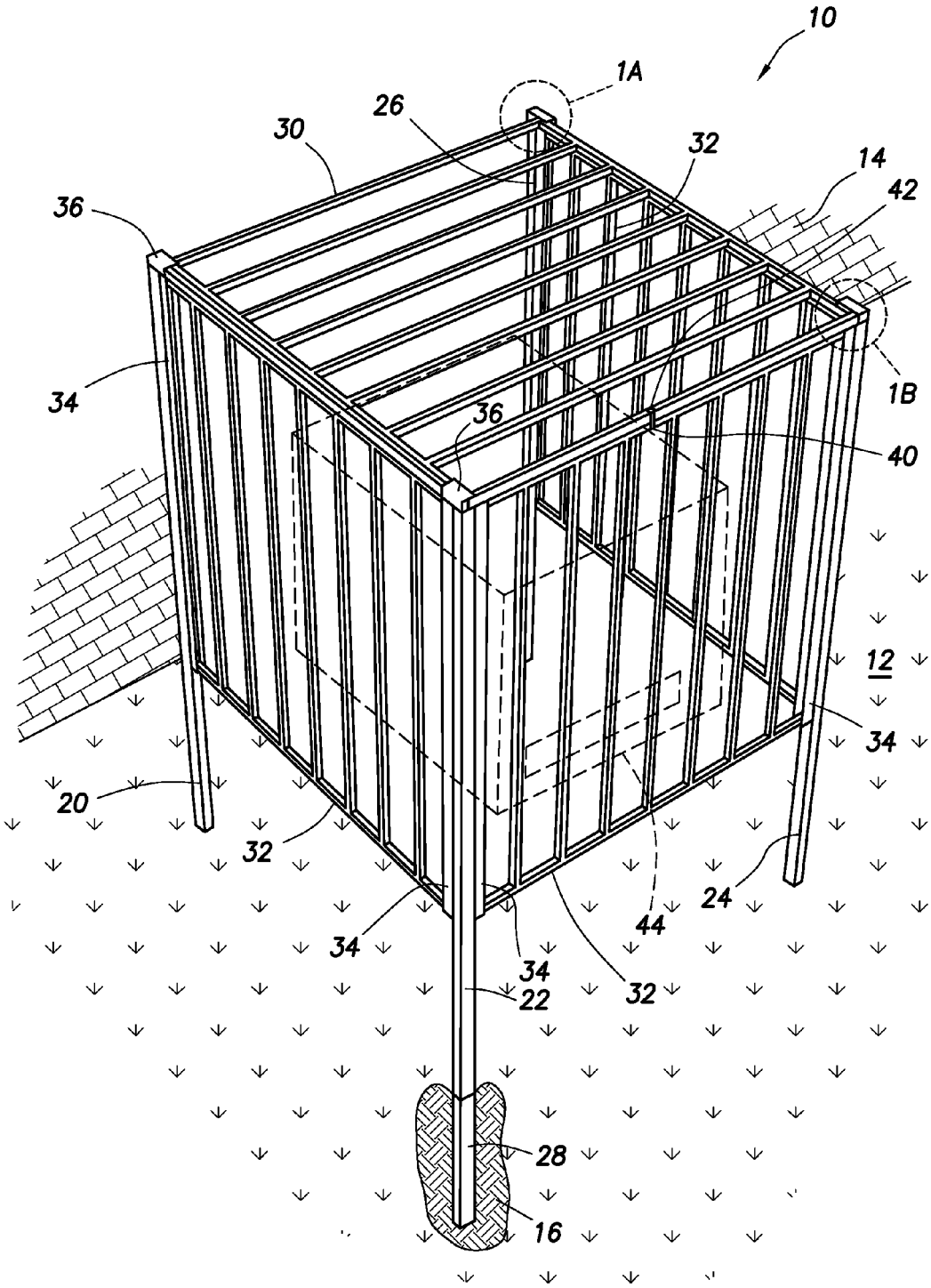
FIG. 1 is a representative perspective view of a security enclosure which can embody principles of this disclosure.

Representatively illustrated in FIG. 1 is a security enclosure 10 and related method for securing equipment 44 within the security enclosure that can embody principles of this disclosure. FIG. 1 shows the enclosure 10, with supports 20, 22, 24, 26 and panels 30, 32, installed outdoors next to a building 14. The supports 20, 22, 24, 26 are arranged in a generally rectangular (including square) configuration. Side panels 32 are inserted between adjacent ones of the supports (e.g. supports 20 and 22, 22 and 24, and 24 and 26, and 26 and 20). This configuration does not show a side panel inserted between adjacent supports 26 and 20, but it can readily be seen that a side panel may be installed between adjacent supports 26 and 20, if desired. A top panel 30 is inserted between the supports 20, 22, 24, 26 to prevent removal of the side panels 32 and a locking device 50 is installed to prevent removal of the top panel.

In this configuration, the enclosure 10 is installed near a wall of the building 14, so a rear side panel 32 is not necessary. However, if the enclosure 10 were installed in a location that did not restrict access, then a rear panel 32 may be desired to secure the equipment 44 within the enclosure.

The building 14 may be a business, a personal residence, a storage building, etc. The building 14 may require equipment 44 (e.g. air compressors, air conditioning units, welders, blowers, tires, tools, raw material, stock items, consumables, etc.) that needs to be secured from theft, protected from removal during an inventory, etc. The enclosure 10 may provide a secure storage for this equipment 44 at minimal cost to the building owners and provide ease of access to secured items when the locking device 50 is unlocked.

FIG. 1 shows the enclosure 10 installed outside the building 14. However, it can readily be seen that the enclosure may be installed in many other locations. For example the enclosure 10 can be installed on a floor inside the building 14, on a roof of the building, on a wall of the building, on a sidewalk, on a driveway, on a surface of a ship, on a dirt surface, etc. in keeping with the principles of this disclosure.

Also, it is not necessary that the enclosure 10 include four supports 20, 22, 24, 26 or three side panels 32 as illustrated in FIG. 1. For example, the enclosure 10 may form a generally wedge-shaped enclosure. This configuration would position support 20 in the center of the back of the enclosure 10 (e.g. positioned halfway between the positions of supports 20, 26 in FIG. 1). Supports 22, 24 remain in the positions as shown in FIG. 1. Three side panels 32 are inserted between adjacent supports 20 and 22, adjacent supports 22 and 24, adjacent supports 24 and 20, and support 26 is not used. The top panel 30 is wedge-shaped to match the outline of the side panels 32. The top panel 30 prevents removal of side panels 32 when the top panel is inserted in the supports 20, 22, 24. A locking device 50 is installed through holes 40, 42 in a front side panel 32 and top panel 30, respectively, and prevents removal of the top panel 30.

In another example, the enclosure 10 may be rectangular shaped by installing three supports 20, 22, 24, 26 and two side panels 32 along each long side of the rectangle and one side panel 32 installed at each end of the enclosure 10. Therefore, this example would include 6 supports, 6 side panels, one or two top panels 30 (e.g. if the top panel included multiple panels), and the locking device 50. If the top panel consisted of two panels 30, and both are inserted from the front of the enclosure 10, then a single locking device installed between the front side panel 32 and the last top panel 30 inserted would prevent removal of all panels in the enclosure.

However, if the top panels are inserted from a side of the enclosure 10, then a single locking device 50 may be installed between the two top panels 30 and the two side panels 32 on the side from which the top panels were inserted. Additionally, more locking devices 50 may be used to secure the multiple top panels 30. Each locking device 50 may be installed between a single top panel 30 and a single side panel 32, thus preventing removal of the top panel 30 and any side panels inserted between adjacent ones of the supports 20, 22, 24, 26 and below the respective top panel.

In yet another example, the enclosure 10 may be oval shaped (including circular) with four supports 20, 22, 24, 26, four side panels 32, one top panel 30, and the locking device 50. Each of the supports 20, 22, 24, 26 may be equally spaced circumferentially around the oval. In this configuration, support 20 is installed in the rear of the enclosure 10, supports 22 and 26 are circumferentially spaced at 90 degrees around the oval from support 20, and support 24 is circumferentially spaced at 180 degrees from the support 20. A curved side panel 32 is installed between each set of adjacent supports 20, 22, 24, 26, thereby forming the oval (including a circle).

An oval top panel 30 is then inserted in channels on top of each support 20, 22, 26, thereby preventing removal of the side panels 32. The locking device 50 is then installed into aligned features of the top panel 30 and the support 24 to prevent removal of the top panel 30, thus securing contents inside the security enclosure 10.

However, in this configuration it is not required that the supports 20, 22, 24, 26 be installed at an equal spacing around the oval. Also, there may be more or less than four supports 20, 22, 24, 26, more or less than four side panels 32, more than one top panel 30, and more than one locking device 50 installed in this configuration.

Therefore, it can readily be seen that many configurations of panels 30, 32, and supports 20, 22, 24, 26 are possible in keeping with the principles of this disclosure.

The supports 20, 22, 24, 26 may be embedded in a material (e.g. earth formation, cement, etc.) and/or attached to a surface 12, 56, 58 (e.g. floor, wall, cement pad, roof, metal plate, ship deck, dirt, etc.) to provide secure attachment of the supports. In FIG. 1, a portion 28 of support 22 is shown embedded in an earth formation 16 to a depth that substantially prevents removal of the support from the earth formation. Alternatively (or in addition), the portion 28 may be embedded in cement or any other suitable material that substantially prevents removal of the support portion 28 after the portion is embedded in the material. FIG. 1 shows only one support 22 with portion 28 embedded in the material, but it can readily be seen that any of the other supports 20, 24, 26 may be configured with the portion 28 embedded in the material.

Figure 2:
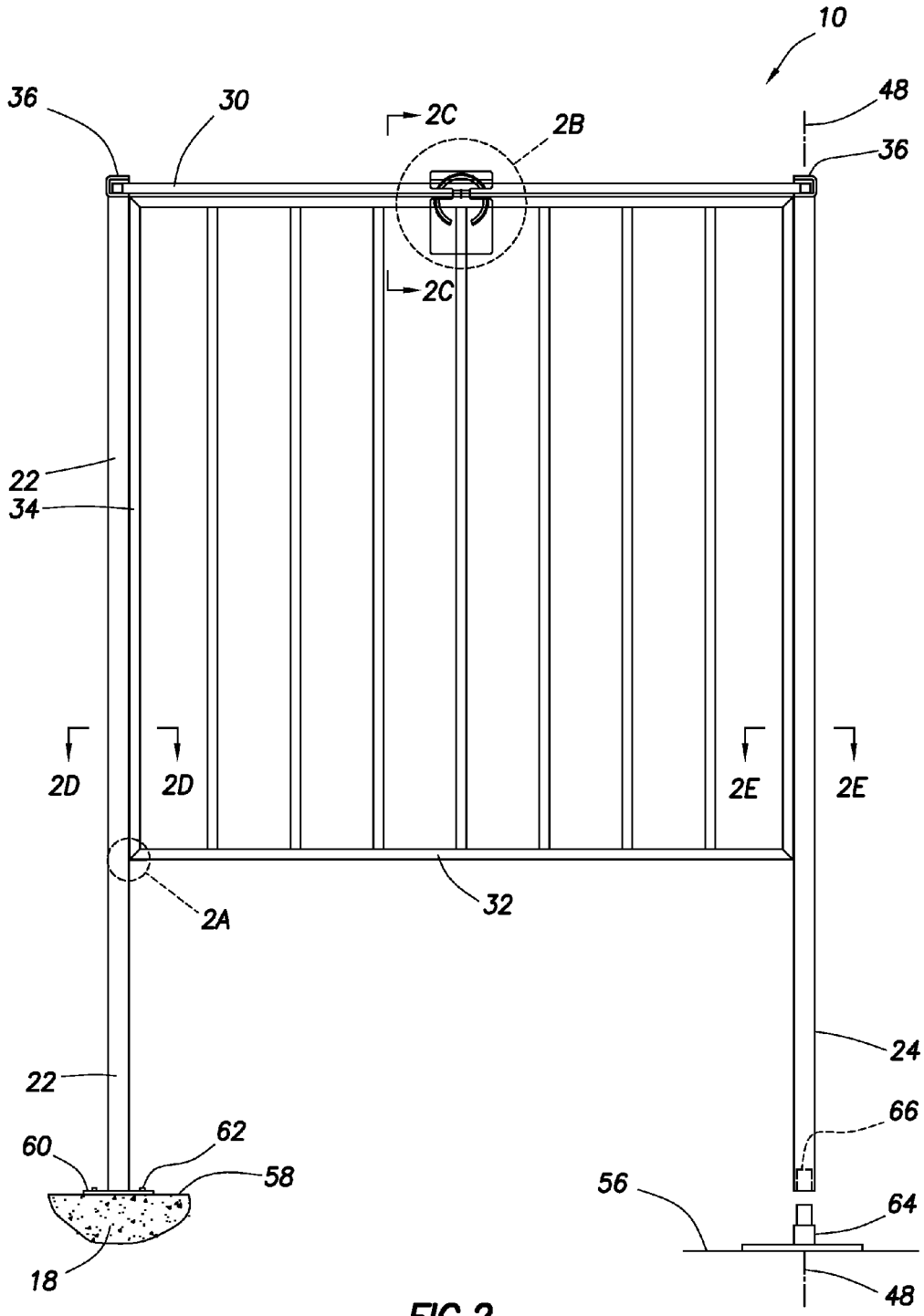
FIG. 2 is a representative front view of a security enclosure which can embody principles of this disclosure.

Referring now to FIG. 2, a support plate 60 is fixedly attached to an end of each support 20, 22, 24, 26 by welding, forming, gluing, etc. The support plate 60 may be fixedly attached to a surface 58 of cement 18 with suitable fasteners 62 to substantially prevent removal of the supports 20, 22, 24, 26 from the surface 58. FIG. 2 shows only one support 22 attached to surface 58, but it can readily be seen that any of the other supports 20, 24, 26 may be configured with the support plate 60 and attached to the surface 58.

Alternatively (or in addition), each support 20, 22, 24, 26 may be configured to mate with a support foot 64. The support foot 64 is attached to a surface 56 (e.g. a roof, a cement pad, a wooden deck, a ship deck, etc.) by welding, bonding, forming, embedding in a material, fastening, etc. After the foot 64 is attached to the surface 56, then an end 66 of the support 20, 22, 24, 26 is attached to the support foot 64 with a suitable attachment means (e.g. mating with a latching means, welding, bonding, attaching fasteners, etc.).

Additionally, a pad may be constructed from any suitable material (e.g. metal, concrete, wood, etc.) with support feet 64 attached to (e.g. embedded in, welded to, fastened to, etc.) the pad to form a base on which the equipment 44 can be placed. Supports 20, 22, 24, 26 may then be attached to the feet 64 by welding, bonding, fasteners, mating latch features, etc., thus securing the supports to the base. The side panels 32 and top panel 30 may then be inserted, and the locking device 50 installed to secure the equipment within the enclosure 10.

Figure 2C:
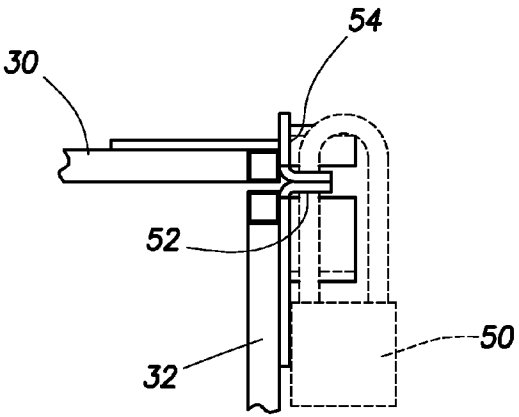
FIG. 2C is a representative cross-sectional view of the locking tabs of the security enclosure of FIG. 2.
Figure 2B:
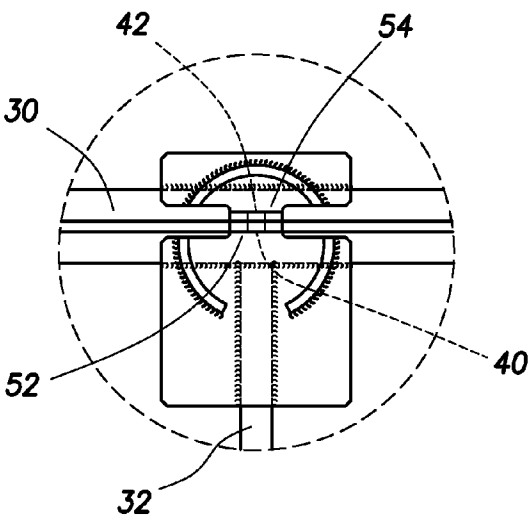
FIG. 2B is a representative detail view of locking tabs of the security enclosure of FIG. 2.
Figure 2A:
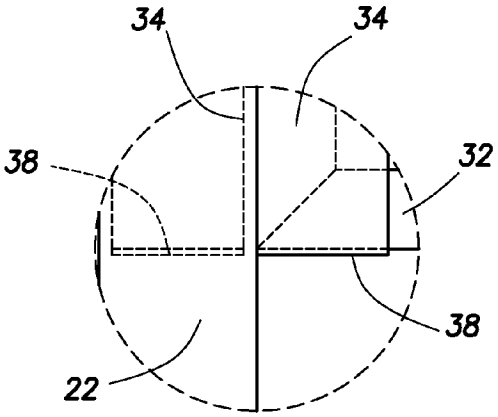
FIG. 2A is a representative detail view of a bottom corner of the security enclosure of FIG. 2.
Figure 2E:
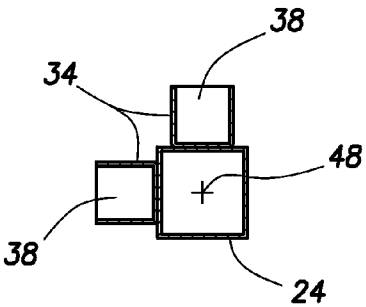
FIG. 2E is another representative cross-sectional view of a support of the security enclosure of FIG. 2.
Figure 2D:
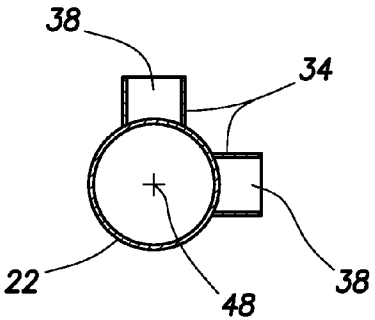
FIG. 2D is a representative cross-sectional view of a support of the security enclosure of FIG. 2.

Referring now to FIGS. 2D-2E, cross-sectional views for supports 22, 24 are shown to illustrate examples of how the supports 20, 22, 24, 26 may be constructed. FIG. 2D shows a circular cross-section of support 22 and longitudinal channels 34 attached on two sides of the support. FIG. 2E shows a square cross-section and longitudinal channels 34 attached on two sides of the support 24. In each example, each channel 34 faces radially outward from a center axis 48 of the support 20, 22, 24, 26.

Clearly the supports 20, 22, 24, 26 may be constructed from several types of tubing (e.g. square, rectangular, circular, oval, triangular, star, etc.), and/or C-channel, angle-bracket, etc. in keeping with the principles of this disclosure.

Please note, the longitudinal channel 34 may be a continuous channel, or it may consist of multiple channel segments. Additionally, the channels 34 are not required to be attached to the supports 20, 22, 24, 26 facing radially outward. The channels 34 may be attached to the supports 20, 22, 24, 26 facing tangential (or any other direction) to the center axis 48.

Referring again to FIG. 1, side panels 32 are inserted into the longitudinal channels 34 on adjacent ones of the supports 20, 22, 24, 26. In particular, one side panel 32 is inserted (or installed) into longitudinal channels 34 of adjacent supports 20 and 22. Another side panel 32 is inserted into longitudinal channels 34 of adjacent supports 22 and 24. Yet another side panel 32 is inserted into longitudinal channels 34 of adjacent supports 24 and 26. Yet another side panel 32 may be inserted into longitudinal channels 34 of adjacent supports 20 and 26 (not shown).

Each longitudinal channel 34 may have a stop 38 (see FIG. 2A) at one end to prevent the side panel 32 from extending past the end of the longitudinal channel 34 when the panel 32 is inserted into the channel. The stop 38 may be anything that blocks advancement of the side panel 32 once the side panel reaches the end (or near the end) of the channel 34 (e.g. flange of metal, bolt extending into the channel 34, a welded pin extending into the channel, a pin extending across legs of the channel, the surface 12, 56, 58 positioned just past the end of the channel, etc.).

It is not required that the stop 38 be mounted to the support 20, 22, 24, 26. For example, the longitudinal channel 34 may extend along the support 20, 22, 24, 26 to just before the surface 12, 56, 58 (or even below the surface) so that the surface would act as the stop 38 for the side panels 32. In this configuration, the gap between the side panels 20, 22, 24, 26 and the surface 12, 56, 58 would be minimal. Therefore, the side panels 32 may extend past the end of the longitudinal channel 34 a short distance without jeopardizing the security of any contents stored within the enclosure 10.

Figure 1A:
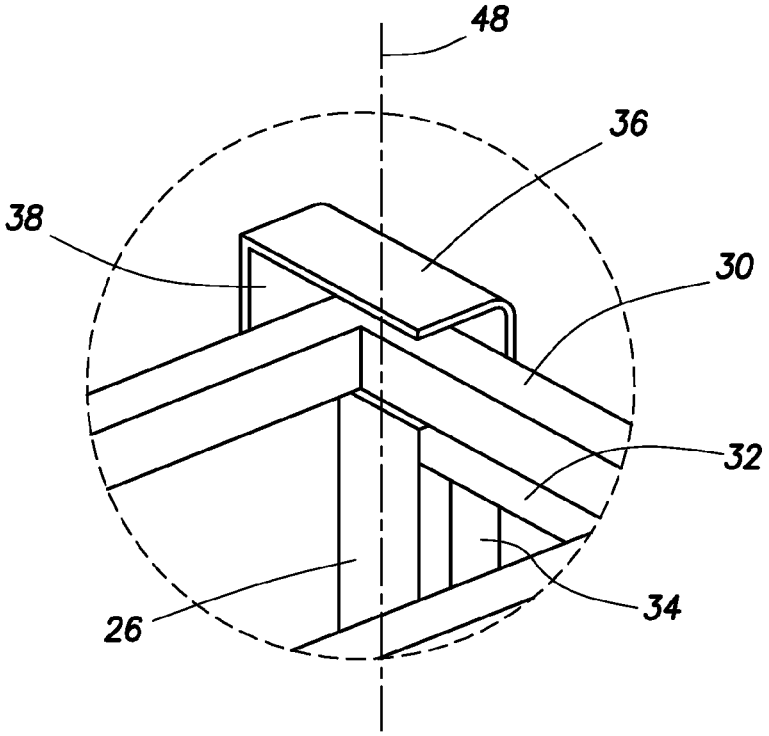
FIG. 1A is a representative perspective detail view of a back corner of the security enclosure of FIG. 1.

Referring now to FIG. 1A, the side panel 32 is inserted into the longitudinal channel 34 on support 26. The top panel 30 is inserted into an orthogonal channel 36 which can be attached to the top of the support 26 and/or formed as an integral part of the support 26. The channel 36 has a stop 38 at one end. The stop 38 prevents the top panel 30 from extending beyond the channel 36. However, it is not required for the orthogonal channel 36 to have a stop at the end. Additionally, the channel 36 and stop 38 may reverse roles by using the channel 36 as the stop and using the stop 38 as the channel in keeping with the principles of this disclosure.

Figure 1B:
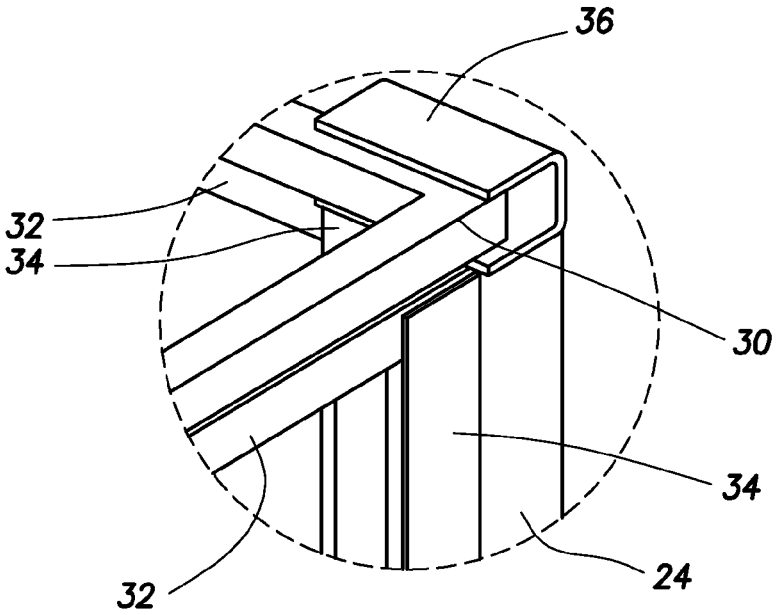
FIG. 1B is a representative perspective detail view of a front corner of the security enclosure of FIG. 1.

Referring now to FIG. 1B, one side panel 32 is inserted in one longitudinal channel 34 attached to the support 24. Another side panel 32 is inserted in a second longitudinal channel 34 attached to the support 24. The top panel 30 is inserted in the orthogonal channel 36 and is substantially perpendicular to the side panels 32. The orthogonal channel 36 attached to the top of the support 24 does not include a stop 38. Similarly, the orthogonal channel 36 attached to the top of support 22 does not include a stop 38. This allows the top panel 30 to be inserted through orthogonal channels 36 on supports 22, 24 and into the orthogonal channels 36 on supports 20, 26 where stops 38 prevent extension of the panel 30 past the end of the channels 36 on supports 20, 26. The channels 36 do not interfere with the insertion (or installation) of the side panels 32.

Referring now to FIG. 2, the side panel 32 is inserted into longitudinal channels 34 of supports 22, 24 until the side panel engages the stop 38 (see FIG. 2A). After side panels 32 are inserted into adjacent ones of the supports 20, 22, 24, 26, then the top panel 30 is inserted in the orthogonal channels 36 and the locking device 50 is installed in the locking features of the top panel and side panel 32.

Referring now to FIGS. 2B and 2C, the side panel 32 has a hole 40 disposed in a locking tab 52. The top panel 30 has a hole 42 disposed in a locking tab 54. When the top panel 30 is inserted, the holes 40, 42 are aligned to allow for the installation of the locking device 50 through the holes.

Please note that it is not required that the holes 40, 42 be disposed in the tabs 52, 54. As seen in FIG. 1, the holes 40, 42 are disposed in the top panel 30 and side panel 32, respectively, without using tabs 52, 54. Alternatively (or in addition), the locking device may be installed around segments of the panels 30, 32 without using holes 40, 42.

The locking device 50 in FIG. 2C is shown to be a conventional keyed padlock. However, the locking device may be any suitable locking device that securely latches the panels 30, 32 together, (e.g. a locking pin, a combination lock, a locking cable, a locking clamp, an electronic lock, etc.). Therefore, it can readily be seen that there are many configurations of the locking device 50 and locking features that are in keeping with the principles of this disclosure.

Figure 3:
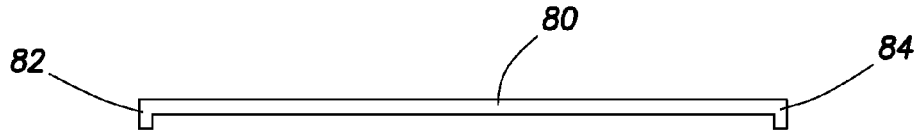
FIG. 3 is a representative front view of a reinforcement bar.

Referring now to FIG. 3, a reinforcement bar 80 with ends 82, 84 is shown. The reinforcement bar 80 may be made from any suitable material (e.g. C-channel, angle-bracket, metal tubing, plastic tubing, bar stock, etc.) that provides reinforcement between the supports 20, 22, 24, 26 to substantially prevent separation of the supports. It may readily be seen that if one of the supports 20, 22, 24, 26 were forcibly displaced away from the other supports, then it may be possible to remove panels 30, 32 without unlocking the locking device 50. Therefore, the reinforcement bar 80 provides additional resistance to displacement of the supports 20, 22, 24, 26 away from each other by connecting adjacent ones of the supports together. The ends 82, 84 are inserted into slots in the top of the adjacent ones of the supports (e.g. supports 20 and 22, 22 and 24, etc.). The ends 82, 84 interlock with the supports 20, 22, 24, 26 to substantially prevent separation of adjacent supports.

It can readily be seen that there are many ways to connect adjacent ones of the supports 20, 22, 24, 26 together. The slots can be formed, cut, pressed, etc. into a cap at the top of the supports 20, 22, 24, 26. A reinforcement bar 80 made from bar stock with each end 82, 84 of the bar bent at 90 degrees and facing the same direction after the ends are bent. The ends 82, 84 may then be inserted into the slots in the caps of adjacent ones of the supports 20, 22, 24, 26 to connect the supports together.

Additionally, the slots may begin at the top of the supports 20, 22, 24, 26 and be formed, cut, pressed, etc. along a side of the supports. The ends 82, 84 of the reinforcement bar 80 may form an L-shape, T-shape, etc. that allows the ends 82, 84 to be inserted into the slots along the sides of adjacent ones of the supports 20, 22, 24, 26, thus connecting adjacent supports together.

Additionally, the ends 82, 84 may be formed so that they encircle the support 20, 22, 24, 26. Therefore, it is not required that the ends be inserted into the top of the support.

Figure 4:
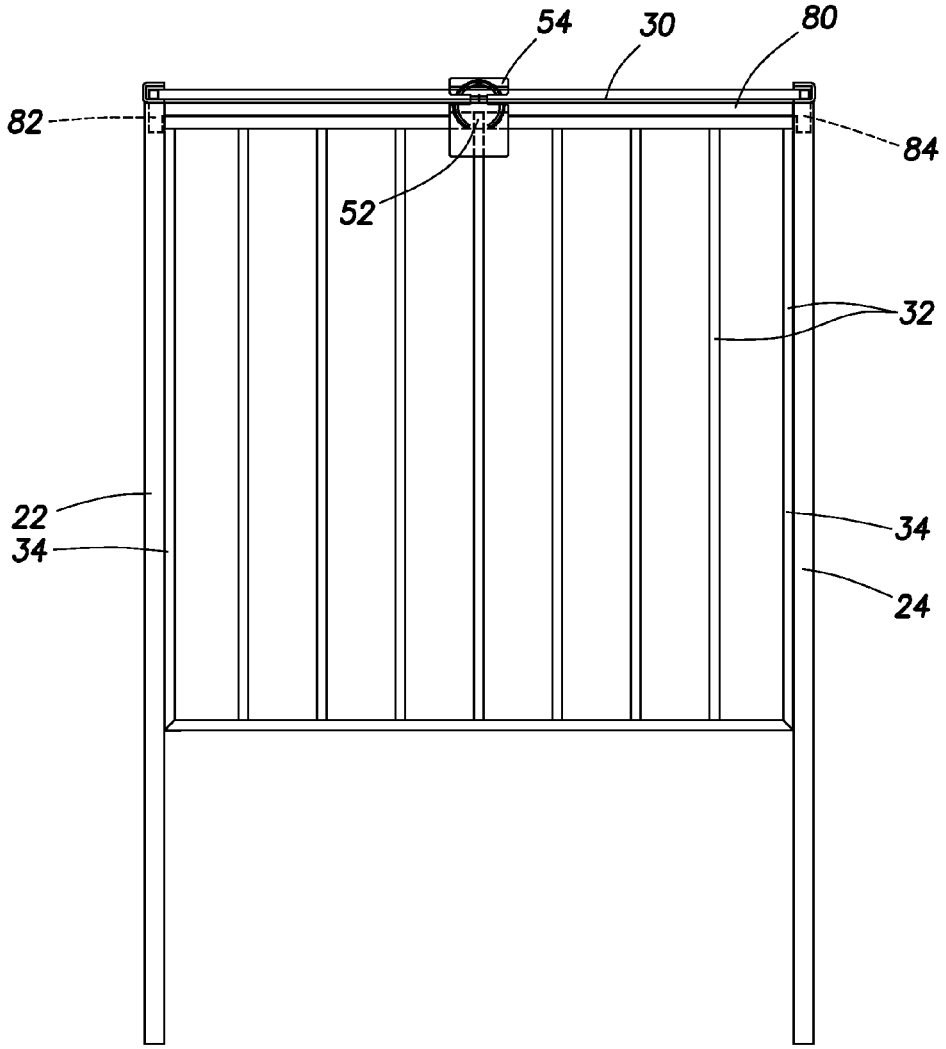
FIG. 4 is a representative front view of the security enclosure with the reinforcement bar installed.

Referring now to FIG. 4, the side panel 32 is inserted in the longitudinal channels 34 of adjacent supports 22, 24. The reinforcement bar 80 is then installed above the side panel 32 with the ends 82, 84 interlocking with the supports 22, 24, respectively. Therefore, when force is applied to the support 22 in an attempt to forcibly displace it, the reinforcement bar 80 connecting supports 22 and 24 together transfers the force to support 24. Therefore, both supports 22, 24 would tend to be displaced together, substantially preventing separation of the supports 22, 24. The reinforcement bar 80 may be installed above each side panel 32 of the enclosure 10 to provide increased resistance to forcible displacement of the supports 20, 22, 24, 26. It can readily be seen that the reinforcement bar 80 is not required, but it can provide additional structural stability of the enclosure 10, if desired.

Referring now to FIGS. 5-8, these figures show various configurations of the panels 30, 32. Each configuration is shown to be rectangular and flat, but as given above, these panels may be curved, square, oval, circular, etc. in keeping with the principles of this disclosure. Also, each configuration shows tubing 72 used to provide structure to the panels 30, 32. However, it is not required that tubing 72 be used. For example, solid plates with or without perforations, expanded metal, etc. may be used to produce panels 30, 32.

Figure 5:
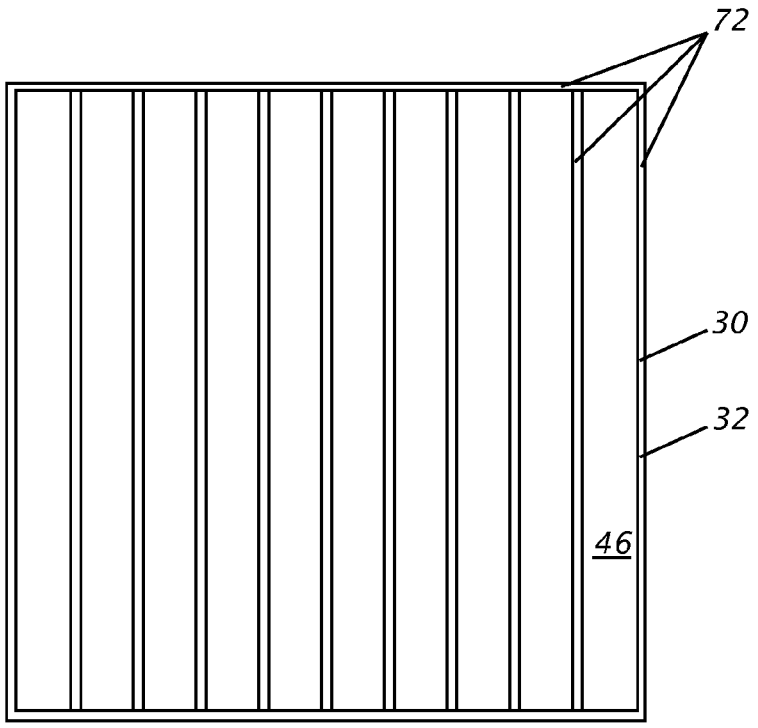
FIGS. 5-8 are representative front views of various panel configurations of panels of the security enclosure.

FIG. 5 shows pieces of tubing 72 arranged and fixedly attached to each other in a rectangular configuration with individually spaced apart pieces of tubing 72 fixedly attached within the rectangle. The openings 46 (e.g. spaces) in between the pieces of tubing 72 provide airflow through the panel 30, 32.

Figure 6:
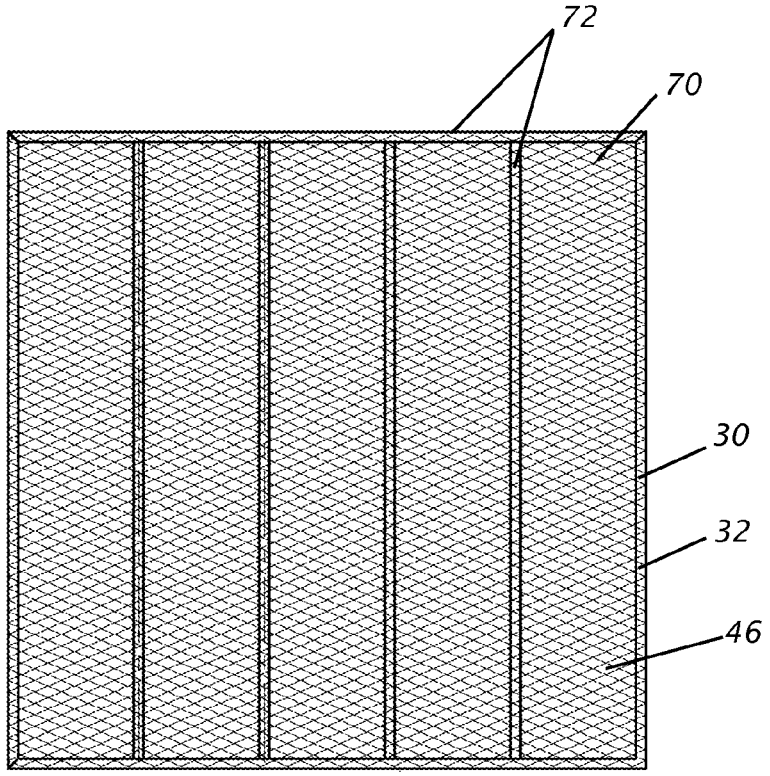

FIG. 6 shows pieces of tubing 72 arranged and fixedly attached to each other in a rectangular configuration with individually spaced apart pieces of tubing 72 fixedly attached within the rectangle. The openings 46 are covered with a mesh material 70 (and/or expanded metal) which provides airflow through the panel 30, 32, but substantially prevents access between the pieces of tubing 72.

Figure 7:
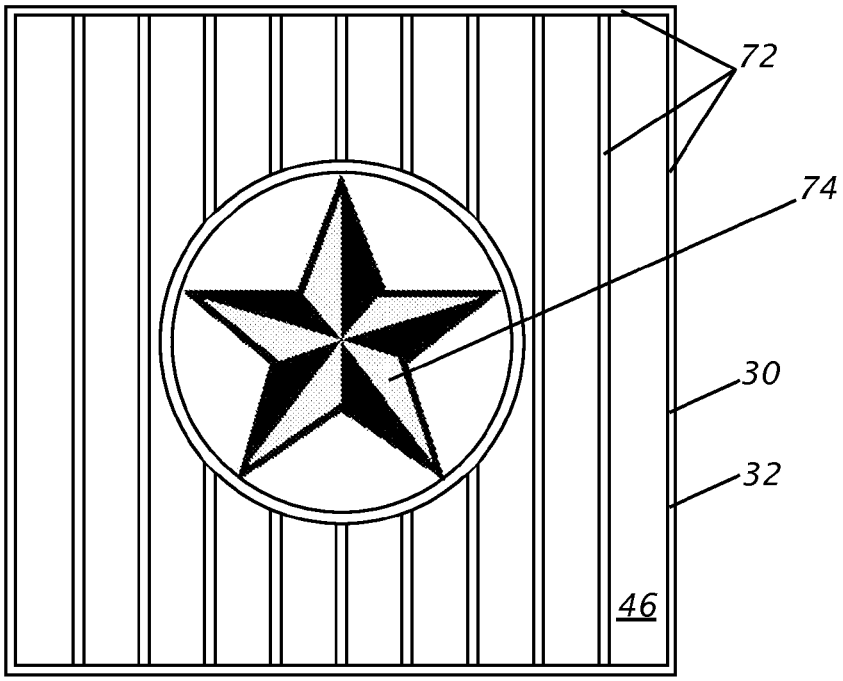

FIG. 7 shows pieces of tubing 72 arranged and fixedly attached to each other in a rectangular configuration with individually spaced apart pieces of tubing 72 fixedly attached within the rectangle. A circular area within the rectangle is outlined with curved tubing 72 and fixedly attached to the individually spaced apart pieces of tubing 72. An emblem 74 (e.g. a star, a silhouette, a company logo, etc.) is fixedly attached within the circular area. This allows the panels 30, 32 to be personalized, if desired, without departing from the principles of this disclosure. The openings 46 in between the pieces of tubing 72 provide airflow through the panel 30, 32.

Figure 8:
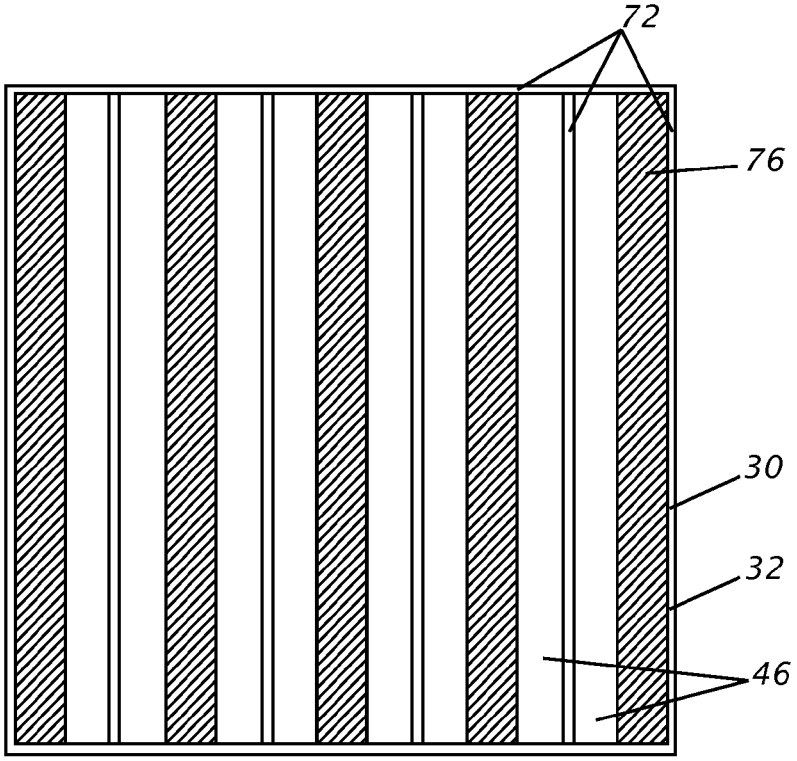

FIG. 8 shows pieces of tubing 72 arranged and fixedly attached to each other in a rectangular configuration with individually spaced apart pieces of tubing 72 fixedly attached within the rectangle. Interposed between each individually spaced apart piece of tubing 72 are planks 76 (e.g. wide tubes, wooden planks, steel plates, etc.) which provide an additional way to personalize the panels 30, 32. The openings 46 in between the pieces of tubing 72 provide airflow through the panel 30, 32.

It can readily be seen that any of these configurations of panels 30, 32 can be used with any of the other configurations in keeping with the principles of this disclosure.

Figure 9:
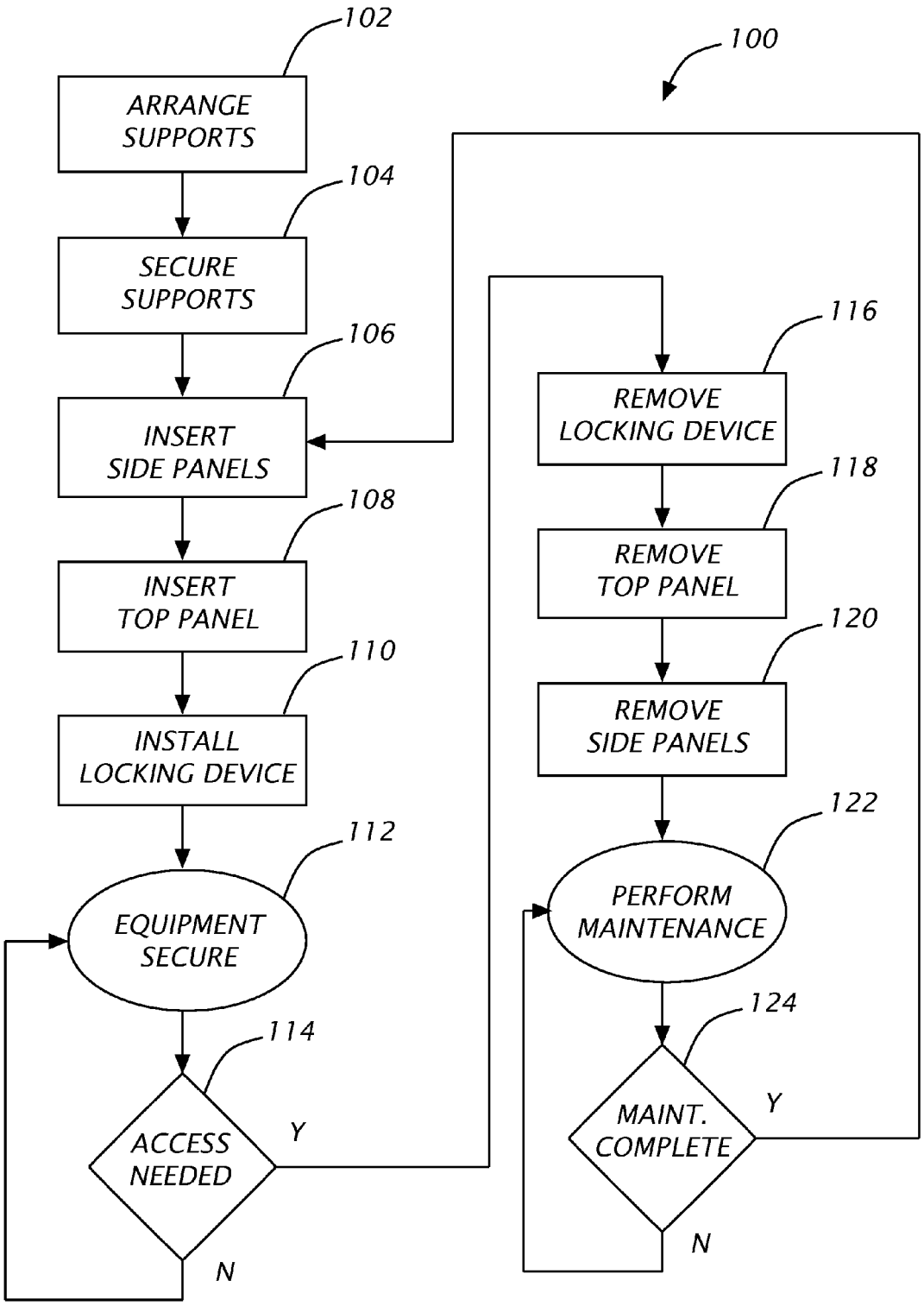
FIG. 9 is a representative flow chart of a method for securing equipment within the security enclosure.

FIG. 9 representatively illustrates a method 100 for securing equipment 44 within an enclosure 10. The method 100 may be used with the enclosure 10, or the method may be used with other enclosures in keeping with the principles of this disclosure.

In step 102, the supports 20, 22, 24, 26 are arranged to form an outline of the enclosure 10. The outline may be wedge-shaped, rectangular-shaped, oval-shaped, etc. as described above.

In step 104, the supports 20, 22, 24, 26 are secured to a surface 12, 56, 58 and/or embedded in a material to substantially prevent removal of the supports. This step may also include securing the supports 20, 22, 24, 26 to a base which includes a pad with support feet 64 attached to the pad. The supports are then secured to the feet 64 after the base is positioned in its desired location.

In step 106, the side panels 32 are inserted into longitudinal channels 34 of adjacent ones of the supports 20, 22, 24, 26 until they engage stops 38 (or the surface 12, 56, 58, if stops 38 are not provided) at the end of the channels 34. If reinforcement bars 80 are used, then these bars are installed above each side panel interlocking adjacent ones of the supports 20, 22, 24, 26 together.

In step 108, the top panel 30 is inserted into the orthogonal channels 36 on top of each support 20, 22, 24, 26. The top panel 30, once inserted, substantially prevents the removal of the side panels 32.

In step 110, the top panel 30 and one of the side panels 32 are adjusted so the holes 40, 42 are aligned and the locking device 50 may be installed through the holes to substantially prevent removal of the top panel 30.

In step 112, with the locking device 50 installed, the equipment 44 within the enclosure 10 is secured and substantially prevented from being removed from the enclosure.

In step 114, a decision is made as to whether or not access to the equipment 44 within the enclosure 10 is needed. If not needed, the locking device 50 remains installed and the equipment 44 remains secured by the enclosure 10. However, if access to the equipment 44 is needed, then the process advances to step 116.

In step 116, the locking device 50 is unlocked and removed allowing removal of the top panel 30.

In step 118, the top panel 30 is removed from the orthogonal channels 36 and removed from the enclosure 10.

In step 120, if reinforcement bars 80 are used, these bars are removed and then the side panels are removed from longitudinal channels 34 and removed from the enclosure 10.

In step 122, all panels 30, 32 have been removed and access to equipment 44 within the enclosure 10 is allowed. At this time, any maintenance operation may be performed, including removing and replacing the equipment 44. For example, if the equipment 44 is an outside air-conditioning unit (A/C unit), then the A/C unit may be checked for refrigerant levels, heat exchanger coils cleaned, parts replaced, and/or the entire A/C unit replaced. Therefore, the unlocking of a single locking device 50 permits access to the equipment 44 within the enclosure 10.

In step 124, a decision is made as to whether or not the maintenance operation is complete. If not, then the enclosure 10 remains in a configuration that allows access to the equipment 44 within the enclosure. If the operation is complete, then the process proceeds back to step 108 and the enclosure 10 is reassembled to again secure equipment 44 within the enclosure.

These steps may be repeated as often as access to the equipment 44 within the enclosure is either desired or not desired.

It will now be fully appreciated that the above disclosure provides several advancements to the art of security enclosures. The above disclosure provides to the art the security enclosure 10 for securing the equipment 44. The enclosure 10 may include at least three supports 20, 22, 24, 26 and each support 20, 22, 24, 26 may be secured to a surface 12, 56, 58. At least two panels 30, 32 may be installed between adjacent ones of the supports 20, 22, 24, 26. The locking device 50 may selectively permit and prevent removal of the panels 30, 32. The equipment 44 may be secured within the enclosure 10 when the locking device 50 prevents removal of the panels 30, 32. The panels 30, 32 may be made of steel, stainless steel, aluminum, glass, expanded metal, mesh, plastic, and/or wood.

One of the panels 30, 32 may include openings 46 which permit airflow through the panels 30, 32. Each support may have a rectangular, square, oval, and/or circular cross-section and may be secured to the surface 12, 56, 58, thereby substantially preventing removal of the supports 20, 22, 24, 26 from the surface 12, 56, 58.

A reinforcement bar 80 may be installed between the adjacent ones of the supports 20, 22, 24, 26, thereby substantially preventing displacement (e.g. separation) of the adjacent ones of the supports 20, 22, 24, 26 relative to each other.

One side of each support 20, 22, 24, 26 may include a longitudinal channel 34 that runs parallel to a center axis 48 of the support 20, 22, 24, 26 and may face radially outward from the center axis 48. The longitudinal channel 34 may have a stop 38 at one end.

One of the supports 20, 22, 24, 26 may include another longitudinal channel 34 that may also run parallel to the center axis 48 of the support 20, 22, 24, 26, may face radially outward from the center axis 48, and may be circumferentially spaced apart from the other longitudinal channel 34.

A panel 32 may be inserted in one of the longitudinal channels 34 of each adjacent ones of the supports 20, 22, 24, 26. An orthogonal channel 36 may be attached to an end of each one of the supports 20, 22, 24, 26 and may be substantially orthogonal to the center axis 48 of the support 20, 22, 24, 26.

One of the panels 30, 32 may be inserted in the orthogonal channels 34 of the adjacent ones of the supports 20, 22, 24, 26. A locking device 50 may be engaged to prevent the removal of the panel 30, 32 inserted in the orthogonal channels 36, which may prevent removal of all panels 30, 32.

One of the panels may permit and prevent removal of the other panels, where each of the panels may be retained between adjacent ones of the supports.

A method 100 of securing equipment 44 in a security enclosure 10 may include the steps of arranging supports 20, 22, 24, 26 around equipment 44 to be secured and may include securing the supports 20, 22, 24, 26. The method may also include inserting a first panel 32 between adjacent ones of the supports 20, 22, 24, 26, and inserting a second panel 30 in the supports 20, 22, 24, 26. The second panel may prevent removal of the first panel from the supports and each panel may be retained between adjacent ones of the supports The method 100 may include installing a locking device 50 to secure the equipment 44 within the enclosure 10. The installing step may include the step of securing the second panel 30 to the first panel 32 which may prevent removal of all panels 30, 32. The method 100 may include the step of removing the locking device 50, thereby allowing removal of all panels 30, 32 to provide maintenance access to the equipment 44.

The method 100 may include the step of installing a reinforcement bar 80 between the adjacent supports 20, 22, 24, 26 prior to the step of inserting the top panel 30, thereby substantially preventing separation of the adjacent supports 20, 22, 24, 26 relative to each other.

The securing step may include a step of embedding an end of each one of the support 20, 22, 24, 26 into an earth formation 16 and/or into a volume of cement 18, which may prevent removal of each one of the supports 20, 22, 24, 26 from the earth formation 16 and/or the volume of cement 18.

The securing step may include a step of attaching an end of each one of the supports 20, 22, 24, 26 to a surface 12, 56, 58, which may prevent removal of each one of the supports 20, 22, 24, 26 from the surface 12, 56, 58.

The first panel 32 may be inserted into a longitudinal channel 34 on each of the adjacent ones of the supports 20, 22, 24, 26 and the second panel 30 may be inserted into an orthogonal channel 36 on top of each one of the supports 20, 22, 24, 26.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "top," "bottom," "side," etc., are used for convenience in referring to the accompanying drawings. In general, "above," "upper," "upward" and similar terms refer to a direction away from the earth's surface, and "below," "lower," "downward" and similar terms refer to a direction toward from the earth's surface.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A security enclosure for securing equipment, the enclosure comprising:

first and second panels;

at least two supports, wherein a first channel of each of the supports slidingly receives the first panel within the first channel in a first direction, and wherein a second channel of each of the supports slidingly receives the second panel within the second channel in a second direction orthogonal to the first direction; and a locking device which secures the second panel in place within the supports, whereby removal of the first and second panels is prevented when the locking device is engaged.

2. The enclosure of claim 1, wherein the equipment within the enclosure is secured when the locking device prevents removal of the panels.

3. The enclosure of claim 1, wherein the panels are made of a material selected from at least one of steel, stainless steel, aluminum, glass, expanded metal, mesh, plastic, and wood.

4. The enclosure of claim 1, wherein the panels include openings which permit airflow through the panels.

5. The enclosure of claim 1, wherein each of the supports comprises a structure having one of a rectangular, square, polygon, C-channel, L-angle, oval, and circular cross-section.

6. The enclosure of claim 1, wherein at least one of the supports is secured firmly in position, thereby substantially preventing removal of the enclosure from about the equipment.

7. The enclosure of claim 1, wherein a reinforcement bar is installed between the supports, thereby substantially preventing displacement of the supports relative to each other.

8. The enclosure of claim 1, wherein the first channel of each of the supports includes a first longitudinal channel which runs parallel to a longitudinal axis of the support.

9. The enclosure of claim 8, wherein the first longitudinal channel has a stop at one end.

10. The enclosure of claim 8, wherein at least one of the supports includes a second longitudinal channel which runs parallel to the longitudinal axis and is spaced apart from the first longitudinal channel.

11. The enclosure of claim 8, wherein the first panel is inserted into the first longitudinal channels.

12. The enclosure of claim 8, wherein the second channel includes an orthogonal channel which is disposed at an end of each of the supports, wherein the orthogonal channel is substantially orthogonal to the longitudinal axis.

13. The enclosure of claim 12, wherein the second panel is inserted into the orthogonal channels.

14. The enclosure of claim 13, wherein the second panel prevents removal of the first panel from the first longitudinal channels when the second panel is positioned in the orthogonal channels.

15. The enclosure of claim 13, wherein the locking device, when engaged, prevents removal of the second panel from the orthogonal channels, thereby preventing removal of all panels.

16. A method of securing equipment in a security enclosure, the method comprising the steps of:

arranging supports around the equipment being secured;

securing at least one of the supports;

then inserting a first panel in the supports; and then inserting a second panel in the supports, the second panel preventing removal of the first panel from the supports.

17. The method of claim 16, the method further comprising the step of installing a locking device, thereby securing the equipment within the enclosure.

18. The method of claim 17, wherein the installing step further comprises securing the second panel within the supports, thereby preventing removal of all panels.

19. The method of claim 17, the method further comprising the step of removing the locking device, thereby allowing removal of all panels from the supports, and thereby gaining access to the equipment.

20. The method of claim 16, the method further comprising the step of installing a reinforcement bar between adjacent ones of the supports, thereby substantially preventing separation of the adjacent ones of the supports relative to each other.

21. The method of claim 16, wherein the securing step further comprises embedding an end of at least one of the supports into the earth, thereby substantially preventing removal of the support from the earth.

22. The method of claim 16, wherein the securing step further comprises embedding an end of at least one of the supports into a volume of cement and allowing the cement to harden, thereby substantially preventing removal of the support from the volume of cement.

23. The method of claim 16, wherein the securing step further comprises fastening an end of at least one of the supports to a surface, thereby substantially preventing removal of the support from the surface.

24. The method of claim 16, wherein the inserting the first panel step further comprises sliding the first panel into a longitudinal channel on each of adjacent ones of the supports.

25. The method of claim 16, wherein the inserting the second panel step further comprises sliding the second panel into an orthogonal channel on an end of at least one of the supports.

26. A security enclosure for securing equipment, the enclosure comprising:

first and second panels;

at least two supports that slidingly receive the first panel in a first direction, and slidingly receive the second panel in a second direction orthogonal to the first direction, wherein each of the supports includes a first longitudinal channel which runs parallel to a longitudinal axis of the support, and wherein an end of each of the supports includes an orthogonal channel which is substantially orthogonal to the longitudinal axis; and a locking device which secures the second panel in place within the supports, whereby removal of the first and second panels is prevented when the locking device is engaged.

27. The enclosure of claim 26, wherein the second panel is inserted into the orthogonal channels, and wherein the second panel prevents removal of the first panel from the first longitudinal channels when the second panel is positioned in the orthogonal channels.

* * * * *